United States Patent [19]

Barnett et al.

[11] 3,943,220

[45] Mar. 9, 1976

[54] METHOD OF PRODUCING FIBER STRAND

[75] Inventors: Irvin Barnett, Martinsville; George Paul Reimschussel, Readington Township, both of N.J.

[73] Assignee: Johns-Manville Corporation, Denver, Colo.

[22] Filed: Jan. 25, 1971

[21] Appl. No.: 109,549

Related U.S. Application Data

[63] Continuation of Ser. No. 863,032, Sept. 30, 1969, abandoned, which is a continuation of Ser. No. 641,757, May 29, 1967, abandoned.

[52] U.S. Cl. ..... 264/103; 57/58.89; 57/164; 264/183

[51] Int. Cl.[2] ..... D02G 1/20; D01D 5/14

[58] Field of Search ..... 57/164, 58.89; 264/183, 264/103, 184

[56] References Cited

UNITED STATES PATENTS

| | | | |
|---|---|---|---|
| 2,698,972 | 1/1955 | Keeler | 19/150 |
| 2,700,866 | 2/1955 | Strang | 57/156 |
| 2,817,947 | 12/1957 | Strang | 57/12 |
| 2,913,364 | 11/1959 | Miller et al. | 162/178 |
| 2,955,017 | 10/1960 | Boyer | 264/183 |
| 2,972,221 | 2/1961 | Wilke et al. | 264/103 |
| 3,062,702 | 11/1962 | Guandigne et al. | 260/898 |
| 3,400,189 | 9/1968 | Nacke | 264/167 |
| 3,423,925 | 1/1969 | George et al. | 57/164 |
| 3,442,997 | 5/1969 | Parratt | 264/108 |
| 3,452,532 | 7/1969 | Wilke et al. | 57/164 |
| 3,453,818 | 7/1969 | Novak et al. | 57/164 |
| 3,475,894 | 11/1969 | Wilke et al. | 57/58.89 |
| 3,617,437 | 11/1971 | Bagg et al. | 162/153 |
| 3,630,012 | 12/1971 | Guerfler | 57/153 |
| 3,634,568 | 1/1972 | Donaldson et al. | 264/183 |
| 3,759,027 | 9/1973 | Barnett | 57/140 BY |

FOREIGN PATENTS OR APPLICATIONS

| | | | |
|---|---|---|---|
| 824,446 | 12/1959 | United Kingdom | 264/103 |

*Primary Examiner*—Jay H. Woo
*Attorney, Agent, or Firm*—Robert M. Krone; James W. McClain

[57] ABSTRACT

A wet process for producing continuous strands from discontinuous inorganic fibers by extruding and aligning a dispersion of said fibers in a liquid medium, which medium contains a gelable agent, into a coagulating bath to gel and convert the agent to a binder for the fibers until they are mechanically interlocked, and subsequently removing the binder. A fibrous strand produced in accordance with the process, with and without the binder included.

5 Claims, 2 Drawing Figures

METHOD OF PRODUCING FIBER STRAND

CROSS REFERENCE TO RELATED APPLICATIONS

This application is a continuation of Application Ser. No. 863,032 filed Sept. 30, 1969, and now abandoned, which in turn is a continuation of Application Ser. No. 641,757 filed May 29, 1967, also now abandoned.

BACKGROUND OF THE INVENTION

This invention relates to a new and improved method for the production of inorganic fibrous dispersions and formation of continuous strands therefrom. More particularly, this invention relates to a novel method for the production of continuous strands, having improved characteristics, from relatively short inorganic fibers, particularly asbestos fibers.

The processes for forming filamentary or strand material may be broadly classified as (1) dry, (2) wet, and (3) melt spinning.

Dry processes for forming continuous filaments or strands from discrete fibers involve the use of relatively expensive equipment such as cards, spinning frames and other complex machinery and also create the usual dust problems attendant with the handling of dry discrete particles.

Conventional wet processes for forming inorganic fibrous strands usually involve the making of a waterlaid paper which is slit and twisted. The known wet processes for directly extruding a continuous strand from inorganic fibers involve a chemical or thermal reaction of a colloidal fibrous dispersion whereby the dispersion medium is converted into a binding agent for the fibers or else a portion of the colloidal dispersion of fibers is converted into a binding agent.

The resultant products have a cementitious, twisted paper appearance, are relatively stiff and are deficient in the elongation requisite for high speed weaving and braiding operations. Furthermore, the production of strands from colloidal dispersions of asbestos fibers requires the use of a relatively large quantity of surface-active agents to sufficiently deflocculate or open asbestos fiber bundles to form the gelatinous colloidal dispersion. The preparation of the colloidal dispersions also results in such a drastic reduction of fiber length that a binder must be relied upon to define and maintain the integrity of strands formed therefrom.

The production of strand material by melt spinning is usually conducted by melting materials, such as synthetics (nylon and the like), glass, and others to form a solution which is extruded to form a continuous filament strand. In contrast, this invention is concerned with the production of a continuous strand from discontinuous relatively short fibers.

OBJECTS AND SUMMARY OF THE INVENTION

It is a primary object of this invention to provide a more simple and facile method of forming a continuous strand from inorganic fibrous bodies containing fibers which are greater than colloidal in size.

It is another object of this invention to provide a wet method of forming a continuous strand of inorganic fibers, which strand has improved fibrous textile characteristics as opposed to a twisted paper-like image.

It is a further object of this invention to provide a method of forming a continuous strand of inorganic fibers, which strand has improved physical characteristics, when compared to strands of corresponding "cuts" but made in accordance with conventional methods.

The objects of this invention are accomplished by soaking a supply of inorganic fibers, such as asbestos, in an aqueous solution containing a wetting agent. The quantity of wetting agent employed is sufficient to assist in the mechanical dispersion of the fibers but insufficient to form a colloidal dispersion. In some instances, where the fibers are sufficiently dispersed, a wetting agent may not be required. A gelable water thickening agent is then added to the slurry of mechanically dispersed fibers to increase the viscosity of the dispersion and deter flocculation of the fibers. There is no reliance on a chemical reaction between the thickening agent and the fibers. The thickened dispersion is extruded through an orifice into a coagulating bath, where the thickening agent is continuously converted into a congealed, substantially water insoluble, coherent reversible binder for the fibers, which fibers are extended substantially in parallel alignment with each other as a result of the extrusion. The formed roving of fibers, binder, and wetting agent, is collected as a continuous strand. At this stage, the fibers may be described as being in relatively spaced apart relation entrained within the binder gel. The strand is then advanced between pressure rolls, where the water content is substantially reduced and adjacent fibers are squeezed within the strand into closer relation with each other, to winding means where the strand is collected into package form. The winding means is preferably in the form of a spinning pot which is axially reciprocated. The spinning pot also serves to extract some of the water content from the formed strand. The strand is wound at preferred rates in respect to the rate at which it is being advanced in order to impart an initial twist to the fibers and thus mechanically interlock the fibers within the gel. If desired, additional twist may be imparted to the strand in a separate twisting operation, such as on a twisting frame. Preferably, the strand packages are then rinsed with a solution which solubilizes and reconverts the reversible binder into a soluble phase which may be extracted and reclaimed for reuse as a thickener and binder. A precipitant may be formed on the strand package as a result of this last step; however, the precipitant may be easily rinsed off and the residue strand is essentially 100% fibers, unless other materials are purposely included.

A valuable feature of the instant invention is that it permits the formation of asbestos strand material directly from a slurry, without the need of first making a paper or felt, or forming on a supporting member such as a wire strand or the like, and without the need of forming a colloidal dispersion of the asbestos, i.e., a supporting member is optional.

DESCRIPTION OF DRAWING

The invention will be more fully understood and other objects and further scope of applicability of the present invention will become apparent from the detailed description hereinafter given and from the accompanying drawing in which.

DESCRIPTION OF PREFERRED EMBODIMENTS

Figure 1:
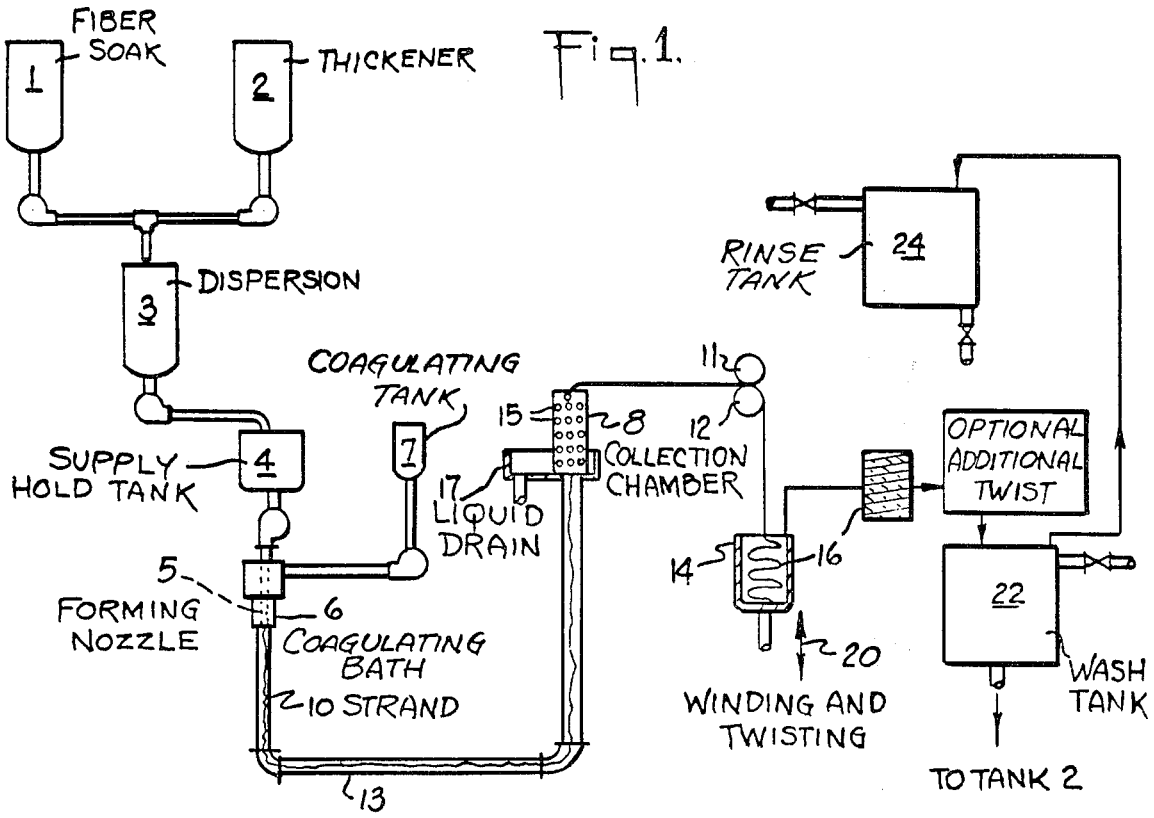
FIG. 1 is a process flow chart schematically illustrating the preferred steps of the method comprising this invention.

In the process schematically illustrated in FIG. 1, a dispersion of discrete inorganic fibers is prepared by soaking the fibers in an aqueous medium containing a wetting agent in a quantity which will not break down the fibers to colloidal diameters or gelatinous state. Descriptions of "colloidal" and "non-colloidal" diameters or dispersions may be found in U.S. Pat. No. 2,626,213 to I. J. Novak. Novak's patent also sets forth a list of "surface-active" agents which produce his colloidal dispersions. Such agents are used in this invention but in quantities which will only produce a "wetting-agent" function. This dispersion or slurry of fibers is mixed and held in soak tank 1, preferably at a temperature of 80° to 110°F, and more preferably at 80° to 90°F. The dispersion is a "mechanical" separation of fibers, as opposed to a "colloidal" dispersion. a colloidal dispersion, particularly when asbestos fibers are employed, is avoided because with a drastic reduction in diameter of the fiber bundles there is usually a concomitant reduction in fiber length. A reduction in fiber length detracts from the ability of the fibers to be later mechanically interlocked. Mechanical interlocking of the fibers is one of the important aspects of this invention. Colloidal dispersions of fibers are considered to be too viscous to attain proper alignment of individual fibers and subsequent interlock, as by twisting. Furthermore, end products made from colloidal dispersions of fibers display a propensity to revert to slurries when subjected to hot fluids. This propensity is particularly objectionable when yarns made with fibrous colloidal dispersions are used to fabricate joint packings for use in conjunction with hot aqueous fluid conduits or systems.

Usually a cycle of ½ – 2 hours will be sufficient to thoroughly mix and disperse the fibers with and within the wetting agent. Of course, the time will vary depending upon the quantity being mixed and the nature of the fibers or type thereof, and the type of stirring or mixing apparatus. The wetting agents that are preferably employed in the process of this invention may be classed as "rewetting" agents, i.e., after once being in solution and dried, they may be softened again by rewetting. Non-rewetting agents, after being wetted and dried, are not reversible to a softened condition by rewetting.

In thickener tank 2 a solution is formed by mixing a thickening agent, preferably one of the polysaccharide water soluble gums which exhibit hydrophilic colloidal properties, in water for a time sufficient to dissolve the agent, which time may be in the order of ½ to ¾ hours. One of the reasons for the preference of the polysaccharide gums is because of their capacity to gel or solidify, and form a film. However, in the process of the instant invention, they are not employed in quantities from which a self-sustaining film can be formed. The quantities employed are sufficient to form a temporary binder for the fibers. The gel may be removed easily after serving the function of a binder, recovered for reuse without need of purification, and thus contributes to a commercially feasible process for extruding strands. In some cases where the strand is to be further processed mechanically such as when the strand is to be used in a weaving process, it may be desirable to leave the binder in the formed strand until the processing is completed, for example, after the cloth is woven. This obviates the necessity for what would otherwise be an additional step. In the weaving of asbestos yarns or strands, they are usually treated with lubricants and other strength imparting materials prior to the weaving step.

The fibrous slurry from the fiber soak tank 1 and the gelable solution containing a thickening agent from thickener tank 2 are thoroughly admixed in dispersion tank 3. The thickening agent increases the viscosity of the slurry so that the fibers are entrained, suspended, and float (like logs in a river) within the slurry to facilitate their subsequent alignment. Thus the thickening agent may be described as serving to maintain the fibers in dispersed relation.

The viscosity of the dispersed fibrous admixture is maintained between 10,000 to 80,000 cps. An admixture having a viscosity less than 10,000 cps is considered to be too fluid. The preferred fibrous solids content is 3% to 7% by weight. An admixture having a viscosity in excess of 80,000 cps is difficult to cycle, as by pumping, and deters the proper generally parallel alignment of the fibers. Also, in an admixture containing a solids content in excess of 7%, it becomes more difficult to properly "wet-out" the fibers and thereby produce the proper mechanical interlock between the parallel fibers after they have been formed into a strand. With an admixture containing less than 3% fiber solids, the fibers become dispersed to such a degree that it is difficult to coagulate the fibers and form a strand which will have sufficient strength for further mechanical processing. The temperature of the admixture is preferably maintained by suitable means in the range of 50° to 60°F; however, it is sufficient in most cases to maintain the dispersion in a liquid state, i.e., at a temperature between the freezing point of the dispersing medium (water 32°F) and the point at which the dispersing medium begins to turn to vapor (water 180°F).

Figure 2:
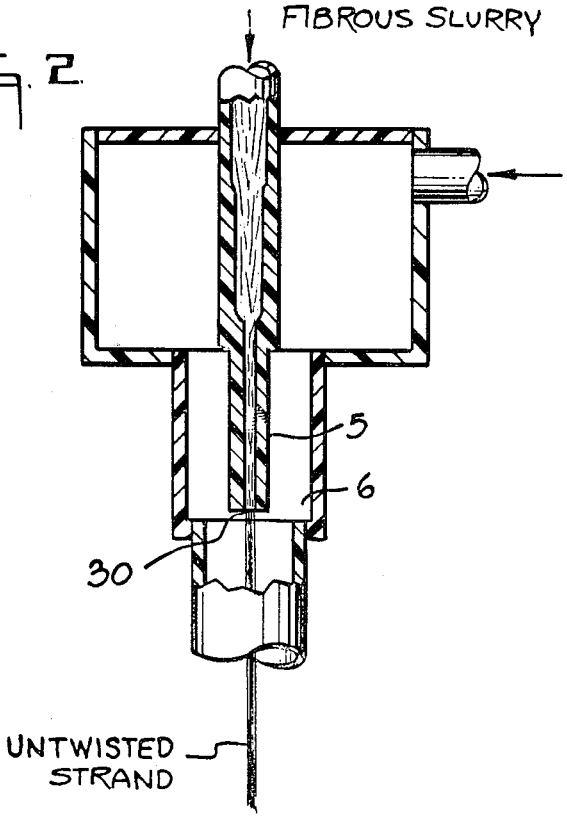
FIG. 2 is a cross-sectional elevational view of an extruding or forming nozzle that may be employed in the method of this invention.

From the dispersion tank 3 the admixture is pumped to a supply tank 4 which is maintained under constant pressure by suitably regulating the pressurizing medium. Air, at 15 psi gage, has been found to be admirably suited for this purpose. The admixture is then distributed to one or more forming nozzles 5 through which the fibers are oriented and exuded, by extrusion, in substantially parallel alignment with each other into a coagulating bath 6 circumposing the terminus 30, of extrusion nozzle 5. It is important that the dispersion be in a thoroughly mixed state just prior to extrusion. A suitable form of nozzle extruding into a coagulating bath is illustrated in detail in FIG. 2. However, it will be apparent that other forms may be employed.

The bath 6, delivered from coagulating tank 7, converts the thickening agent into a gel which coheres the fibrous content of the strand 10. The binder particles adhere to the fibers at countless points, but not as a continuous film, so that fibers are joined and united together in oriented fashion. Fibers can slide over each other but as twist is imposed, the interlocking forces offer resistance to fiber slippage. The fiber particles do not rely on mutual bonding forces for aggregation as a solidified form but rather are first held together by the included binder and subsequently by mechanical interlock.

The strand 10 is advanced through passage 13 together with the coagulating bath being pumped to collection chamber 8 where the liquid portion of the pumped material drains through perforations 15 to drain 17. The coherent strand 10 is then collected in a collection chamber 8 from which the strand may be withdrawn without being subjected to undue tension. The coherent strand 10 may be advanced from the collection chamber 8 between a pair of rollers 11 and 12, preferably at least one being driven, to a rotating or spinning collection pot 14, where the strand is wound into a "cake" 16. The rollers 11 and 12 serve to compact and mechanically condense the strands to bring adjacent fibers into closer relation and to further substantially reduce the liquid content. A traversing action is imparted to the strand as it is being wound by also reciprocating the pot in a direction corresponding to the axis of rotation, as indicated by arrow 20. An advantage of using the spinning pot is that as the strand is being wound, sufficient twist may be automatically imparted to the strand to carry it into a package form without the fibers disintegrating from the strand form. After twist is imparted to strands of this type, they are less susceptible to being disintegrated. The centrifugal forces imposed on the strand 10 by the spinning pot 14 substantially further reduce the liquid content of the strand 10. The pot 14 may optionally be provided with a perforated wall to facilitate the removal of the extracted liquid from the interior of the pot.

The formed cake 16 is then removed from the spinning pot 14 and may be optionally rewound on conventional apparatus, such as a twisting frame, to impart additional twist to the strand. It is noteworthy that strands made from discrete inorganic fibers and in accordance with the teachings of this process require less twist per unit length than strands made from the same grade of fibers by the so-called dry processes to impart the same tensile strength.

The packages of twisted strand are then washed, as in wash tank 22, with an aqueous solution containing a chemical ingredient which will revert the gel back to the constituent employed as a thickening agent. This reverted agent may be then reclaimed, by cycling off, for reuse in making the gel forming solution in tank 2.

During the extraction of the binder from the formed twisted strand packages 16, depending upon the materials used for making and reverting the binder, a precipitant or salt may be formed on the surface of the package. The strand packages 16 are preferably moved to a rinse tank 24 where the precipitant may be rinsed away without contaminating the reverted binder. After drying, the strand packages 16 are ready for use in the same manner as strands made by any other process.

Contrary to known processes for extruding fibers as a continuous strand, the process of this invention starts with discrete fibers, as opposed to colloidal dispersions of fibrous material or of synthetic filament forming materials, in a liquid suspension medium and does not involve the usual steps of converting the colloidalizing or dispersing medium to form a binder. Instead the continuous strand is formed by converting an entraining liquid thickening agent into a reversible binder. These features define a process which is distinctly different from previous processes.

The instant invention is characterized by the fact that gel forming materials, such as sodium alginate, are used to form a temporary binder until such time that the inorganic fibers may be mechanically interlocked and then the temporary binder is extracted. The materials which are useful in forming temporary binders are those which characteristically exhibit hydrophilic colloidal properties. A family of such material that is found to be particularly useful are those known as water soluble natural gums, in which family sodium alginate and guar gum form a part. The grades of gelatin which also exhibit hydrophilic colloidal properties, i.e., those which have the propensity to swell in, dissolve in, or absorb water, have also been found to be particularly useful.

While specific and preferred embodiments of the binder or gel forming materials are described and set forth, it will be understood that other binder forming materials may be employed, if they meet the following specifications:

1. Chemically compatible with the fibrous material employed and with the fiber dispersing medium (surface active agent);
2. Type which will not enhance further dispersion of the fibers to a colloidal state;
3. Capable of being coagulated and of imparting shape and continuity to the extruded fibers;
4. Contribute to, or be compatible with another material that will provide a high viscosity of slurry;
5. Resultant gelled binder forms a discontinuous phase or is at least non-impervious (hydrophilic) to liquid medium of slurry so that the liquid, which might otherwise become entrapped, may be extracted;
6. Gelled binder must be capable of being elongated, at least when in a wet state (if it cannot be elongated in dry state, it should be capable of being rewetted); and
7. Capable of being extracted from strand after twist has been imparted without adversely disrupting the shape and continuity of the strand or fibers, relative to chemical or thermal exposure.

The invention is further illustrated by the following examples wherein the parts, unless otherwise specified, are by weight and wherein the nominal length of the fibers is not shorter than that specified for Group 4 by the Quebec Asbestos Miner's Association is its Quebec Standard Screen Test for chrysotile asbestos fibers (all of the designated groups and grades are in accordance with Quebec Standard Screen Test unless otherwise designated).

EXAMPLE I

An aqueous dispersion of chrysotile asbestos fibers comprising, 19.4 lbs. of spinning grade fibers normally designated as Groups 3 and 4, were mixed with 400 lbs. water at 105°F, 2.2 lbs. of organic fibers in the form of viscose rayon of 1 inch lengths and 5 denier, and 2.8 lbs. of an anionic surface active agent, sodium alkyl sulfonate, exemplified by the product Alkanol WXN sold by the DuPont Company, in soak tank 1 to form a fibrous slurry. The surface active agent served as a wetting agent to mechanically disperse the fibers.

In another tank 2, a thickened water solution formed by mixing and stirring 4.8 lbs. of sodium alginate powder (a gelable water thickening agent) with 280 lbs. of water for a time sufficient to dissolve the sodium alginate.

The fibrous slurry form tank 1 and the thickened water solution from tank 2 were then thoroughly admixed in dispersion tank 3 to form an admixture. From the dispersion tank the admixture was pumped to supply tank 4 for distribution to one or more forming nozzles 5 through which the fibers were oriented and exuded in substantially parallel alignment with each other into coagulating or "hardening" bath 6.

The coagulating bath 6 was formed from 1250 lbs. water, 50 lbs. of acetic acid and 37.5 lbs. of calcium carbonate which reacted to form acidified calcium acetate, with a surplus of acid. The bath had a specific gravity of 1.04 and pH factor maintained in the range of 3 to 6, preferably at 4. The bath was directed to the extrusion nozzles through suitable flow rate controls.

After the strand 10 was formed by extruding the fibrous admixture through the nozzles, the strand was coagulated in the coagulating bath and collected in collection chamber 8. The soluble sodium alginate was converted by contact with the calcium acetate, in the bath, to an insoluble calcium alginate which cohered and formed the binder for the fibrous content of the strand. The sodium acetate which formed was dissolved in the coagulating bath.

From the collection chamber 8 the strand was advanced through the squeeze rolls 11 and 12 which served to mechanically condense the roving from an approximately 95% water content to an approximately 70% water content and brought the individual fibers which were adjacent to each other in closer relation. The compression of the strand while the binder was being gelled or "hardened" consolidated the fibers. The liquid between the fibers was "squeezed out", without replacing the "squeezed out" liquid with air. This feature contributes to the uniformity of the formed strand product.

The condensed strand was then advanced for collection in a spinning pot 14. The spinning pot 14 was preferably rotated at 3400 revolutions per minute to produce approximately 1.3 turns per inch in the strand while the strand was advanced at the rate of 2600 in./-min.

The condensed and initially twisted strand was then additionally twisted, in the same direction, by conventional twisting procedures to impart the required additional twist. The amount of twist depends upon the cut of strand and the required tensile strength. It has been found that only 50 to 70% of the twist required by the conventional so-called dry processes formed strands having comparable tensile strengths is required in strands made by the instant procedure. For example, where 10 turns per inch in 10-cut dry-process formed strand is required only 5 to 7 turns are required in the 10-cut strands made by this procedure.

The packages of twisted strand were then washed in tank 22 with an aqueous solution of sodium carbonate to convert the calcium alginate back to sodium alginate. A calcium carbonate by-product was also formed. The sodium alginate was then reclaimed by recycling for use in tank 2. The calcium carbonate precipitated out on the surface of the formed strand package 16.

The strand packages were then removed from the tank 22 where the binder was extracted to another tank 24 where the calcium carbonate was removed by rinsing with acetic acid. The calcium carbonate was converted to calcium acetate and carbon dioxide. The calcium acetate may be reused to form the coagulating agent; however, it has been found more economical not to reclaim the calcium acetate formed during the instant step of removing the calcium carbonate.

The above formulation produced a typical 90% grade asbestos yarn. A 100% grade asbestos yarn may be produced by omitting the rayon or other organic fibers. It has been found that the inclusion of the rayon or other organic fibers assists in imparting desirable properties, such as fibrous texture or "feel", in the end product. Also, the organic fibers tend to impart viscosity to the solution and thus assist in preventing the coalescence of the asbestos fiber and the breakdown of the apparent homogeneous character of the slurry.

The process also provides a system whereby synthetic filaments may be combined with inorganic fibers without the need of rendering the synthetic filaments tacky.

EXAMPLE II

The following is a typical process which produced an 85% grade ceramic yarn. 5.8 lbs. of fiber (85% alumina silica and 15% organic fibers, preferably of textile length) and 400 lbs. water were mixed with 0.7 lbs. of a cationic surface active agent of alkyl amine composition, exemplified by the product Avitex NA sold by the DuPont Company to form a fibrous slurry in tank 1. Other cationic surface active agents that may be used with ceramic or other yarns requiring cationic agents are listed in Part IV, starting on page 309 of 1953 Technical Manual and Year Book of the American Association of Textile Chemists and Colorists, Vol. XXIX (Published for the Association by Howes Publishing Co. Inc., New York, N.Y.).

4.8 lbs. sodium alginate were added to 280 lbs. of water in thickener tank 2 to form the water thickening agent.

The two solutions were then mixed in dispersion tank 3 and the remainder of the process was similar to that as described in Example I.

EXAMPLE III 2.7 lbs. of chrysotile asbestos fibers, classified as Group 3, were soaked in a solution of 60 lbs. water containing 0.27 lbs. of sodium alkyl sulfonate, a wetting agent exemplified by the product Alkanol WXN, sold by the DuPont Company. 0.6 lb of sodium alginate was mixed with 40 lbs. of water to prepare a binder solution.

The binder solution and the fiber dispersions were mixed in a dispersion tank 3 and extruded through the nozzles 5 into a coagulating bath 6 of acidified calcium acetate, with a surplus of acid, made by reacting 3 lbs. of calcium carbonate and 95% purity acetic acid (4 lbs. acetic acid to 60 lbs. of water) at a temperature less than 100°F. The remainder of the process was similar to that described in Example I. This process produced a 100% grade (ASTM Grade AAAA) asbestos strand.

EXAMPLE IV

A slurry was prepared in a container, corresponding to tank 1, containing 7 parts of grade 3T chrysotile asbestos fiber, 225 parts of water and 3 parts of guar gum, a natural vegetable colloid, exemplified by the product "Jaguar" sold by the Stein-Hall Company. The slurry was extruded into a saturated borax solution. The borax solution provided borate ions in the alkaline system which functioned as a gelling agent for the guar gum, and converted the gum into a gel. The coagulating solution was prepared by mixing 37.9 grams of $Na_2B_4O_7$. 10 $H_2O$/400 milliliters $H_2O$ at 25°C. This mixture exceeded the solubility of borax at room temperature. A saturated solution was prepared by drawing off the supernatant liquid.

After twisting, the strand package was immersed in a 50% solution of glacial acetic acid to make the gel water soluble so that it could be washed out of the strands.

EXAMPLE V

A slurry of 7 parts grade 3T chrysotile asbestos fiber, 1 part of anionic surface active agent, sodium alkyl sulfonate, and 8 parts of commercial grade gelatin, exemplified by a product sold by the Swift Company and designated as Swift 710, were mixed with 225 parts of water. This solution was extruded into a 2% aluminum sulfate solution which served to congeal the gelatin as a temporary binder until the strand could be twisted and the fibers become mechanically interlocked. The gelatin was then rendered water soluble by treatment with hot sodium carbonate for extraction without disturbing the continuity of the strands.

EXAMPLE VI

A slurry comprising 30 parts Group 3 chrysotile asbestos fiber, 1.4 parts anionic surface active wetting agent, and 2 parts of a complex synthetic non-ionic polyacrylamide exemplified by a product sold by the Stein-Hall Company and designated as Polyhall 295, mixed with 300 parts of water was prepared. This solution was extruded into a dilute solution of aluminum sulfate, the aluminum ion of which formed the gelling agent for the binder forming synthetic polyacrylamide. The strand was then twisted to mechanically interlock the fibers. The formed binder was then rendered soluble by treatment with a dilute solution of sodium carbonate. The strand was then rinsed and dried.

EXAMPLE VII

A fibrous slurry was prepared from 8.4 lbs. of crocidolite asbestos fibers (grade Cape "S" blue), 130 lbs. water containing 0.5 lbs. anionic wetting agent (Aersol OT sold by American Cyanamid Company) and 0.4 lbs. soap. The soap was added to serve as a lubricant and facilitate pumping. 2.2 lbs. of sodium alginate were mixed with 75 lbs. water to prepare the binder solution.

The binder solution and the fiber dispersions were thoroughly mixed and extruded through a nozzle into a coagulating bath of the type described in Example III. The remainder of the process was similar to the steps described in Example I. This process produced a 100% grade crocidolite (blue) asbestos strand.

In the processes involving the use of sodium alginate and calcium carbonate, it appears that the optimum strand tensile strengths are obtained when the calcium concentration in the coagulating bath is maintained in the range of 9000 to 15,000 ppm.

It will be understood that the sodium alginate, and other of the main and preferred water thickeners may be modified by substituting other water thickeners, such as by way of example, starches, bentonite and carboxymethyl cellulose, for a part of the main water thickener.

It is inherent of asbestos fibers that with a reduction in diameter of the fiber bundles there is a concomitant decrease in fiber length. With a decrease in fiber length there is less ability for the fibers to be mechanically interlocked and hence other additives or permanent binders are usually required in order for strand materials made from colloidal dispersions to retain their integrity.

The end products of all of these examples are unique in that the comprising fibers are generally of greater length than the fibers in, and do not present cementitious paper-like appearance of, products made from colloidal dispersions. The process may be employed to process strands from any of the inorganic fibers of discontinuous lengths. It is not limited to the use of chrysotile asbestos fibers of the serpentine group but may be employed as well with the use of crocidolite asbestos fibers, representative of the amphibole group. The fibers used in the process of this invention correspond to the lengths of the fibers of grade 4Z or better of the Quebec Standard Screen Test wherein at least 10% are ¼ inch and longer.

The preferred end strand product may be further characterized as deriving its final shape and integrity from the fibers per se and not from any included material, such as a binder. The process may also be characterized as maintaining the fiber length and diameter attained during the initial fiber dispersion, i.e., the temporary binder agent does not contribute to further dispersion of the fiber bundles.

Some of the advantages and characteristics of strands made in accordance with the method of the present invention, as compared with known wet extrusion methods, will become more apparent from the following resume:

| Present Invention | Prior Art Wet Process |
|---|---|
| Non-colloidal dispersion — suitable for processing various types of fibers | Colloidal dispersion — suitable for processing chrysotile asbestos |
| Long fibers, other than inorganic, may be admixed with the inorganic fibers | Limited to processing asbestos fibers |
| A mechanical fiber suspension water thickening system is employed — fibers may be removed and the water thickening system still functions | Colloidal (chemical) thickening system, wherein fibers are a part and cardinal agent of the thickening and binder mechanisms, is employed — if fibers are removed, the thickening and binder systems are destroyed — chrysotile asbestos is critical element in binder system |
| Hydrophilic temporary binder — facilitates reaction penetration of relatively coarse strands | Hydrophobic binder restricts system to use with strands of relatively fine diameters |
| Textile characteristics — fibrous appearance<br>good flexibility<br>soft<br>porous<br>ability to be elongated | Paper-like structure — twisted paper image<br>relatively stiff<br>paper feel<br>tight-poor absorbency<br>insufficient elongation for high speed weaving and braiding operations |
| Packings made from strand maintain their integrity when subjected to hot fluids | Packings made from strand have propensity to revert to slurries when subjected to hot fluids |

The improvements and advantages of asbestos strands produced by the method of the present invention, as compared with those made by conventional dry process, may be summarized as follows:

Greater uniformity in weight, diameter, strength and purity (higher asbestos content from fibers of equal grade)

Greater strength, when compared with dry process strand produced from fibers of same length — strands of equal strength may be produced from shorter length (lower grade) fibers with less twist per inch — in order to produce a 90% grade asbestos strand of suitable strength with the dry process, a 3K (Quebec Standard Screen Test) or higher grade fiber is considered to be required together with a minimum of 11.5 turns/inch twist in the formed strand — an equivalent strand may be produced by the method of this invention with fibers as low as 3T grade and with only 8 turns/inch twist.

What we claim is:

1. A wet process of producing a continuous unitary coherent strand consisting essentially of twist-interlocked, staple inorganic fibers greater than colloidal in size, which comprises:

a. preparing a noncolloidal water suspension of said staple inorganic fibers, said staple inorganic fibers comprising fibers greater than colloidal in size and having lengths of at least ¼ inch;

said noncolloidal water suspension having a viscosity in the range of 10,000 to 80,000 cps, a temperature in the range of 32° to 180°F, and a solids content in the range of approximately 3 to 7% by weight, and said noncolloidal water suspension being thickened with a reversibly gelable waterthickening agent to said viscosity range, thus maintaining said staple inorganic fibers noncolloidally dispersed in said water suspension and facilitating the orientation of said fibers generally parallel to each other;

b. forming said noncolloidal water suspension into a strand by extrusion of said suspension containing said fibers oriented generally parallel to each other;

c. converting said reversibly gelable waterthickening agent in the extruded strand into a substantially water-insoluble temporary gel binder which maintains the orientation of the fibers, permits the release of excess water from the strand, and is capable of being reverted to a water-soluble phase for subsequent removal;

d. reducing the water content of the strand and, by twisting the strand, twisting together and mechanically interlocking the oriented staple fibers; and e. thereafter reverting the substantially water-insoluble temporary gel binder to a water-soluble phase and dissolving the same from the continuous unitary coherent strand of twist-interlocked fibers without destroying the mechanical interlock of the fibers or the continuous unitary nature of the strands.

2. A wet process as defined in claim 1, wherein said reversibly gelable water thickening agent comprises a polysaccharide water-soluble gum which exhibits hydrophilic colloidal properties.

3. A wet process as defined in claim 1, wherein:

a. said staple inorganic fibers greater than colloidal in size comprise asbestos fibers having lengths of at least Grade 4Z of the Quebec Standard Screen Test, b. a wetting agent is included in said noncolloidal fiber water suspension to aid in dispersing the fibers, c. said reversibly gelable water thickening agent comprises sodium alginate, and d. calcium acetate is added to the water suspension comprising asbestos fiber and said sodium alginate reversibly gelable water thickening agent and reacted with the sodium alginate to convert the sodium alginate into calcium alginate as the substantially water insoluble temporary gel binder.

4. A continuous unitary coherent strand consisting essentially of twist-interlocked staple inorganic fibers comprising asbestor greater than colloidal in size, said strand being produced by a process as defined in claim 1.

5. A wet process as defined in claim 1, wherein said strand is further mechanically processed, as by weaving.

* * * * *

UNITED STATES PATENT AND TRADEMARK OFFICE

CERTIFICATE OF CORRECTION

PATENT NO. : 3,943,220

DATED : March 9, 1976

INVENTOR(S) : Irvin Barnett et al

It is certified that error appears in the above-identified patent and that said Letters Patent are hereby corrected as shown below:

Column 5, line 6, the sentence beginning with "The rollers 11 and 12" and ending with "the liquid content", should be a separate paragraph following after and not within the paragraph.

Column 6, line 35, "is" should read --in--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*